US011526123B2

(12) United States Patent
FitzGerald et al.

(10) Patent No.: US 11,526,123 B2
(45) Date of Patent: Dec. 13, 2022

(54) PARTICULATE DELIVERY CONTAINER

(71) Applicant: HEWLETT-PACKARD DEVELOPMENT COMPANY, L.P., Spring, TX (US)

(72) Inventors: Sean Daniel FitzGerald, Boise, ID (US); Jeff Luke, Boise, ID (US)

(73) Assignee: HEWLETT-PACKARD DEVELOPMENT COMPANY, L.P., Spring, TX (US)

( * ) Notice: Subject to any disclaimer, the term of this patent is extended or adjusted under 35 U.S.C. 154(b) by 87 days.

(21) Appl. No.: 17/041,869

(22) PCT Filed: May 24, 2018

(86) PCT No.: PCT/US2018/034306
§ 371 (c)(1),
(2) Date: Sep. 25, 2020

(87) PCT Pub. No.: WO2019/226166
PCT Pub. Date: Nov. 28, 2019

(65) Prior Publication Data

US 2021/0370683 A1 Dec. 2, 2021

(51) Int. Cl.
*G03G 21/18* (2006.01)
*G03G 15/08* (2006.01)

(52) U.S. Cl.
CPC ..... *G03G 21/1814* (2013.01); *G03G 15/0867* (2013.01)

(58) Field of Classification Search
CPC ..... G03G 21/1814; G03G 15/0867; G03G 15/0865; G03G 15/0887
See application file for complete search history.

(56) References Cited

U.S. PATENT DOCUMENTS

| | | | | |
|---|---|---|---|---|
| 2,051,440 | A | 8/1936 | Eicken | |
| 2,906,463 | A | 9/1959 | Curry | |
| 2005/0089347 | A1* | 4/2005 | Muramatsu | G03G 15/0865 399/262 |
| 2010/0231620 | A1 | 9/2010 | Shinada | |
| 2012/0014713 | A1* | 1/2012 | Murakami | G03G 15/0865 399/119 |

(Continued)

FOREIGN PATENT DOCUMENTS

| | | | |
|---|---|---|---|
| CN | 202223694 | U | 5/2012 |
| FR | 2863503 | A1 | 6/2005 |

(Continued)

OTHER PUBLICATIONS

Powder Atomizer, http://www.jinjian.com.tw/products.php?cid=6&id=22.

(Continued)

*Primary Examiner* — Sandra Brase
(74) *Attorney, Agent, or Firm* — Staas & Halsey LLP

(57) ABSTRACT

Examples described herein relate to an apparatus for particulate delivery consistent with the disclosure. For instance, the apparatus may comprise a particulate reservoir container, an orifice positioned at an output portion of the particulate reservoir container, and a baffle that when compressed forces air through an air valve to direct the air below a level of particulates of print material to aerate the particulates of print material.

20 Claims, 5 Drawing Sheets

(56) References Cited

U.S. PATENT DOCUMENTS

| | | | | |
|---|---|---|---|---|
| 2012/0014722 | A1* | 1/2012 | Okino | G03G 15/0867 399/262 |
| 2012/0038719 | A1 | 2/2012 | Shimizu et al. | |
| 2013/0209140 | A1* | 8/2013 | Murakami | G03G 15/0865 399/258 |
| 2013/0222491 | A1 | 8/2013 | Nanjo et al. | |
| 2016/0288511 | A1 | 10/2016 | Koizumi et al. | |

FOREIGN PATENT DOCUMENTS

| | | | |
|---|---|---|---|
| GB | 387863 | | 2/1933 |
| JP | 2011207023 | | 10/2011 |
| WO | WO2015082933 | A1 | 6/2015 |

OTHER PUBLICATIONS

Small Size Bottle Atomizer for Glitter Shimmering Powder Container, https://www.alibaba.com/productdetail/Smallsizeemptybottleatomizerfor-60007431135.html.

* cited by examiner

PARTICULATE DELIVERY CONTAINER

CROSS REFERENCE TO RELATED APPLICATIONS

This application is a U.S. National Stage Application which claims the benefit under 35 U.S.C. § 371 of International Patent Application No. PCT/US2018/034306 filed on May 24, 2018, the contents of which are incorporated herein by reference.

BACKGROUND

Printing devices, such as printers, scanners, and copiers, may generate text, images, or objects on print media, such as paper and plastic. In some examples, generating the text, images, or objects on the print media may include transferring print material, such as ink and toner, to the print media.

DETAILED DESCRIPTION

Printing devices may include a supply to store print material within the printing device for use on a print medium. Printing devices may include printers, scanners, copiers, etc. As used herein, the term "supply" is intended to mean a storage container or reservoir within the printing device to hold a volume of particulates of print material, whether in liquid or solid particle form, for use by the printing device in printing. The supply may have a finite amount of print material disposed within a volume of the supply. As such, the amount of print material in the supply may be reduced during operation of the printing device, for instance, due to application of print material from the supply to the print medium A particulate delivery container including a particulate reservoir container to hold print material may be utilized to transfer a quantity of print material to the supply of a printing device as part of a refilling process. The quantity of print material from within the particulate reservoir container may be transferred through a transfer mechanism associated with the particulate delivery container to a supply associated with a printing device. The transfer mechanism may include a conduit or a passageway capable of coupling the particulate delivery container to an aperture of the supply and be able to transfer print material from the particulate delivery container to the supply.

Accordingly, this disclosure is directed to a particulate delivery container. Devices disclosed herein may provide a way to direct air below a level of particulates of print material within a particulate delivery container. Specifically, a baffle that when compressed may force air through an air valve to direct the air below the level of the particulates of print material to aerate the particulates of print material.

Particulates may respond when presented with air to create space between the particulates to reduce physical interactions and reactions/counter-forces between the particulates. As used herein, the term "particulate" is intended to include a particulate of print material, such as colorant, ink, toner, etc. Thus, aerating the particulates of the print material may aid in the transfer of print material from the particulate delivery container to a printing device's supply container, maximizing the volume of particulates of the print material that transfer from the particulate delivery container. Therefore, minimizing the volume of trapped particulates of print material.

Figure 1:
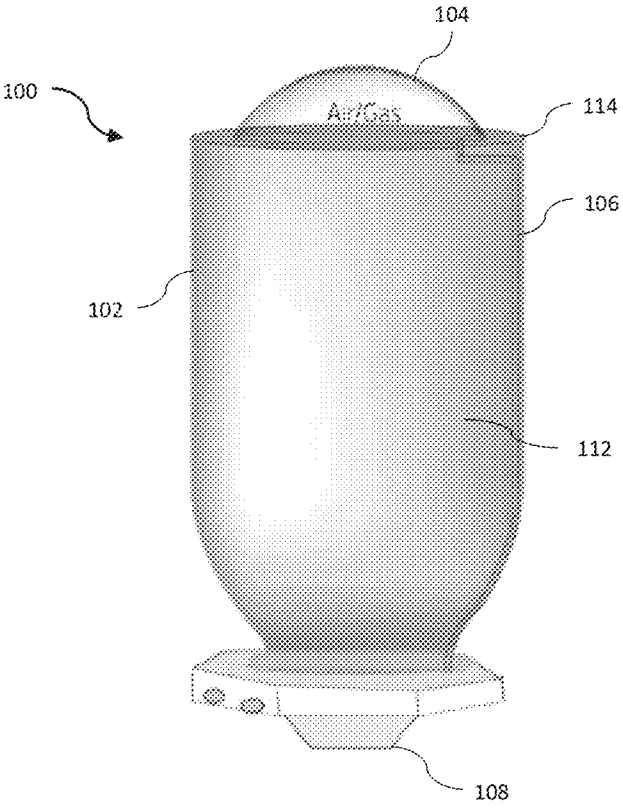
FIG. 1 illustrates an example of an apparatus for particulate delivery consistent with the disclosure.

FIG. 1 illustrates an example of an apparatus 100 for particulate delivery consistent with the disclosure. The apparatus 100 may include a particulate reservoir container 102, an orifice 108 positioned at an output portion of the particulate reservoir container 102, and a baffle 104 that when compressed forces air through an air valve 106 to direct the air below a level 114 of particulates of print material 112 to aerate the particulates of print material 112. The operations are not limited to a particular example described herein and may include additional operations such as those described in the particulate delivery container 210 described in FIG. 2, the system 320 described in FIG. 3, and the particulate delivery container 430 described in FIG. 4.

At some point, the amount of particulates in the supply may be less than a threshold amount of particulates for the printing device to operate as intended. Therefore, the supply may have a quantity of particulates transferred to it so as to refill the supply to include enough particulate for the printing device to operate as intended.

Separately, in one example, the apparatus 100 may be capable of holding and transferring a quantity of the particulates of print material 112 to the supply of the printing device as part of a refilling process. The quantity of the particulates of print material 112 from within a particulate reservoir container 102 associated with the apparatus 100 may be transferred through a transfer mechanism associated with the apparatus 100 to the supply associated with the printing device. The transfer mechanism may include a conduit or a passageway capable of coupling the apparatus 100 to an aperture of the supply and be able to pass print material from the apparatus 100 to the supply.

The apparatus 100 may include a particulate reservoir container 102. The particulate reservoir container 102 may be formed of a material that is capable of storing particulates of print material 112, such as plastic and glass, among other materials. Additionally, the particulate reservoir container 102 may include an input portion, an output portion, and at least one wall. For instance, the particulate reservoir may include an input portion that is capable of receiving particulates of print material 112 and an output portion which is capable of transferring the particulates of print material 112 to an orifice 108, which may be positioned at the output portion of the particulate reservoir container 102. The output portion of the particulate reservoir container 102 may be opposite of the input portion of the particulate reservoir container 102. In one example, the particulate reservoir container 102 may resemble a cylindrical chamber, thus including a cylindrical wall.

The apparatus 100 may include the orifice 108, which may be positioned at the output portion of the particulate reservoir container 102, The orifice 108 may be formed of a material that is capable of transferring the particulates of print material 112 from the particulate reservoir container 102 and out of the apparatus 100, such as plastic and glass, among other materials. The material may be the same or a different material than the material that the particulate reservoir container 102 is formed from. The orifice 108 may include an input portion to receive the particulates of print material 112 from the particulate reservoir container 102 and an output portion to transfer the particulates out of the apparatus 100. In one example, the orifice 108 may include a funnel-like configuration, where the input portion is of the orifice 108 is wider than the output portion of the orifice 108. The orifice 108 may include the funnel-like configuration to avoid corners, sharp angles, and dead spots where the particles of print materials 112 may become trapped during the transfer of print material out of the apparatus 100.

The apparatus 100 may include a baffle 104 that when compressed forces air through an air valve 106 to direct the air below a level 114 of the particulates of print material 112 to aerate the particulates of print material 112, As used herein, the term "baffle" is intended to include a device capable of holding and releasing air. The particulates of print material 112 may become compressed within the particulate reservoir container 102 and/or the orifice 108 making it difficult to transfer the particulates of print material 112 from the apparatus 100. In one example, the air valve 106 can direct air into the particulates of print material 112 to aerate the particulates of print material 112. In another example, the air valve 106 can direct air below the particulates of print material 112 to aerate the particulates of print material 112. Aerating the particulates of print material 112 may aid in transferring the particulates of print material 112 out of the apparatus 100, maximizing the volume of particulates of print material 112 that is transferred from the apparatus 100.

As illustrated in FIG. 1, the baffle 104 may be disposed within the particulate reservoir container 102. In other examples, the baffle 104 may be disposed externally of the particulate reservoir container 102, such as on an external surface of the particulate reservoir container 102. The baffle 104 may be formed from a material that may allow the baffle to be compressed to force air through the air valve 106 that is attached to the baffle 104, such as a rubber material, among other materials. Additionally, the baffle 104 may be sealed or semi-sealed.

In one example, the baffle 104 may be disposed within the particulate reservoir container 102 and filled with air. The baffle 104 may pull air in from an external source or from within the particulate reservoir container 102. The baffle 104 may be disposed above the level 114 of particulates of print material 112. The level 114 of particulates of print material may be an upper surface of the particulates of print material as shown in FIG. 1. A pressure mechanism within or external to the particulate reservoir container 102 may apply pressure to the baffle 104 to compress the baffle 104 forcing the air from the baffle 104 to the air valve 106. In one example, the baffle 104 may be capable of refilling with air upon compression via a one-way valve sealing mechanism. The one-way valve sealing mechanism may include a check valve that is capable of allowing air to flow from the baffle to the particulate reservoir container 102 or the orifice 108 and preventing the particulates of print material 112 from entering the air valve 106. For instance, the one-way air valve sealing mechanism may include a swing check located at a discharge end portion or an input end opening of the air valve 106. The one-way valve sealing mechanism may be located within the air valve 106 that is attached to the baffle 104.

Upon being compressed, the baffle 104 may force air through the air valve 106 to direct the air from the baffle 104 below the level 114 of the particulates of print material 112. Directing the air from the baffle 104 below the level 114 of the particulates of print material 112 may result in air being directed into the particulates of print material 112. The air valve 106 may be formed of a material that is capable of transferring air from the baffle 104 to the particulates of print material 112, such as rubber and plastic, among other materials. In one example, the air valve 106 may be fully disposed within the particulate reservoir container 102. In another example, a portion of the air valve 106 may disposed within the particulate reservoir container 102. In such an example, a portion of the air valve 106 may also be disposed externally of the particulate reservoir container 102, within the orifice 108, and/or externally of the orifice 108. The air valve 106 may be a one-way air valve to ensure that during, before, and after the transfer of air from the baffle 104, the particulates of print material 112 do not enter the air valve 106, For instance, the air valve may include the one-way valve sealing mechanism to ensure that the air flows in one direction within the air valve 106.

The air valve 106 may include an input end opening and a discharge end opening. The input end opening may open into the baffle 104 to allow the transfer of air from the baffle 104 into the air valve 106. In one example, the discharge end opening of the air valve 106 may open into the particulate reservoir container 102 below the level 114 of the particulates of print material 112. In another example, the discharge end opening of the air valve 106 may open into the orifice 108 below the level 114 of the particulates of print material 112.

Supplying air below the level 114 of particulates of print material 112 may aerate the particulates of the print material 112 aiding in the transfer of print material from the particulate delivery container to a printing device's supply container. Therefore, minimizing the volume of trapped particulates of print material 112 within the apparatus 100.

Figure 2:
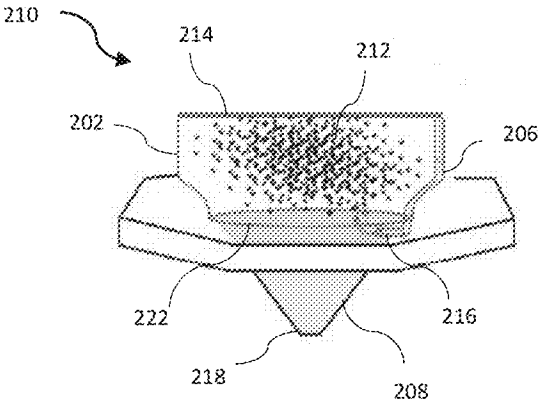
FIG. 2 illustrates an example of a particulate delivery container consistent with the disclosure.

FIG. 2 illustrates a particulate delivery container 210 consistent with the disclosure. The particulate delivery container 210 may include a particulate reservoir container 202, an orifice 208 positioned at an output portion 222 of the particulate reservoir container 202, and a baffle coupled to an air valve 206, where when compressed the baffle forces air through the air valve 206 to direct the air below a level 214 of particulates of print material 212 to aerate the particulates of print material 212. The operations are not limited to a particular example described herein and may include additional operations such as those described in the apparatus 100 described in FIG. 1, the system 320 described in FIG. 3, and the particulate delivery container 430 described in FIG. 4.

In one example, as illustrated in FIG. 2, the discharge end opening portion 216 of the air valve 206 may intersect with a wall of the orifice 208 to direct the air at the particulates of print material 212. In another example, the discharge end portion 216 of the air valve 206 may intersect with a wall of the particulate reservoir container 202 to direct the air at the particulates of print material 212. In such an example, the discharge end opening portion 216 of the air valve 206 may be parallel to the output portion 222 of the particulate reservoir container 202 and/or the output portion 218 of the orifice 208.

In another example, the discharge end portion 216 of the air valve 206 may be disposed at an angle to direct the air towards the level 214 of the particulates of print material 212. In such an example, the discharge end portion 216 of the air valve 206 may be angled towards the input portion of the particulate reservoir container 202. The air valve 206 may include a discharge end opening 216 that is located below the level 214 of the particulates of print material 212 to aerate the particulates of print material 212 allowing for maximum transfer of the particulates of print material 212 out of the particulate delivery container 210.

Figure 3:
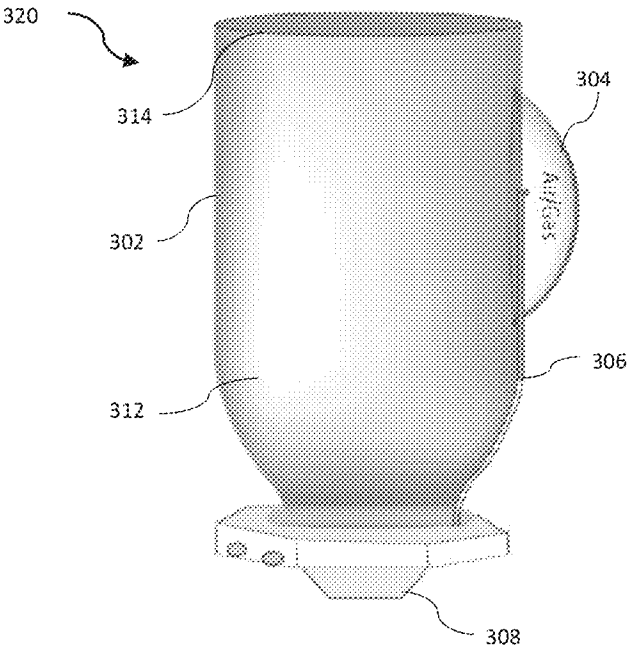
FIG. 3 illustrates an example of a system for a particulate delivery consistent with the disclosure.

FIG. 3 illustrates a system 320 for particulate delivery consistent with the disclosure. The system 320 may include a particulate reservoir container 302, an orifice 308 positioned at an output portion of the particulate reservoir container 302, and a baffle 304 coupled to an air valve 306, wherein when compressed the baffle 304 forces air through the air valve 306 to direct the air below the level 314 of particulates of print material 312 to aerate the particulates of print material 312. The operations are not limited to a particular example described herein and may include additional operations such as those described in the apparatus 100 described in FIG. 1, the particulate delivery container 210 described in FIG. 2, and the particulate delivery container 430 described in FIG. 4.

As described herein, the system 320 may include a particulate reservoir container 302 to hold the particulates of print material 312, The particulate reservoir container 302 may be formed of a material that is capable of storing the particulates of print material 312. Additionally, the particulate reservoir container 302 may include an input portion, an output portion, and at least one wall. In one example, as illustrated in FIG. 3, the particulate reservoir container 302 may resemble a cylindrical chamber, thus including a cylindrical wall.

The system 320 may include the orifice 308, which may be positioned at the output portion of the particulate reservoir container 304. The orifice 308 may be formed of a material that is capable of delivering the particulates of print material 312 to the printing device's supply container. The orifice 308 may include an input portion to receive the particulates of print material 312 from the particulate reservoir container 304 and an output portion to transfer the particulates of print material to the printing device's supply container. In one example, the orifice 308 may include a funnel-like configuration to avoid corners, sharp angles, and dead spots where the particles of print materials 312 may become trapped during the transfer of print material.

As described herein, the system 320 may include a baffle 304 that when compressed forces air through an air valve 306 to direct the air below a level 314 of the particulates of print material 312 to aerate the particulates of print material 312. The particulates of print material 312 may become compressed within the particulate reservoir container 302 and/or the orifice 308 making it difficult to transfer the particulates of print material 312 to the printing device's supply container. Aerating the particulates of print material 312 may maximize the volume of particulates of print material 312 that is transferred to the printing device's supply container.

In one example, as illustrated in FIG. 3, the baffle 304 may be disposed externally of the particulate reservoir container 302, such as on an external surface of the particulate reservoir container 302. The baffle 304 may be formed from a material that may allow the baffle 304 to be compressed to force air through the air valve 306 that is attached to the baffle 304. Additionally, the baffle 304 may be sealed or semi-sealed.

Pressure may be applied to the baffle 304 to compress the baffle 304 forcing the air from the baffle 304 to the air valve 306. In one example, the baffle 304 may be capable of refilling with air upon compression via a one-way valve sealing mechanism. The one-way valve sealing mechanism may be located within the air valve 306 that is attached to the baffle 304.

Upon being compressed, the baffle 304 may force air through the air valve 306 to direct the air from the baffle 304 to the particulates of print material 312. The air may be directed below the level 314 of particulates of print material 312. The air valve 306 may be formed of a material that is capable of transferring air from the baffle 304 to the particulates of print material 312. In one example, the air valve 306 may be fully disposed within the particulate reservoir container 302. In another example, a portion of the air valve 306 may be disposed within the particulate reservoir container 302. In such an example, a portion of the air valve 306 may also be disposed externally of the particulate reservoir container 302, within the orifice 308, and/or externally of the orifice 308. The air valve 306 may be a one-way air valve to ensure that during, before, and after the transfer of air from the baffle 304, the particulates of print material 312 do not enter the air valve 306.

As described herein, the air valve 306 may include an input end opening and a discharge end opening. The input end opening may open into the baffle 304 to allow the transfer of air from the baffle 304 into the air valve 306. In one example, the discharge end opening of the air valve 306 may open into the particulate reservoir container 302 below the level 314 of the particulates of print material 312. In another example, the discharge end opening of the air valve may open into the orifice below the level 314 of the particulates of print material 312.

As described herein, the discharge end opening portion of the air valve 306 may intersect with a wall of the orifice 308 to direct the air at the particulates of print material 312. In another example, the discharge end portion of the air valve 306 may intersect with a wall of the particulate reservoir container 302 to direct the air at the particulates of print material 312.

In another example, the discharge end portion of the air valve 306 may be disposed at an angle to direct the air towards the level 314 of the particulates of print material 312, For instance, the discharge end portion of the air valve 306 may be angled towards the input portion of the particulate reservoir container 302. The air valve 306 may include a discharge end opening that is located below the level 314 of the particulates of print material 312 to aid in the transfer of the particulates of print material 312 to the printing device's supply container.

Figure 4:
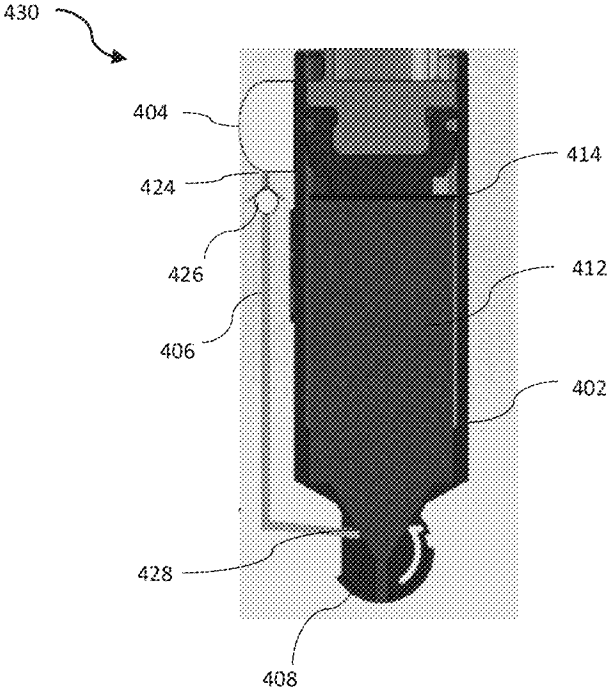
FIG. 4 illustrates an example of a particulate delivery container consistent with the disclosure.

FIG. 4 illustrates a particulate delivery container 430 consistent with the disclosure. The particulate delivery container 430 may include a particulate reservoir container 402, an orifice 408 positioned at an output portion of the particulate reservoir container 402, and a baffle 404 that when compressed forces air through a one-way air valve 406 to direct the air below a level 414 of particulates of print material 412 to aerate the particulates of print material 412, wherein the air valve 406 includes an input end opening 424 at the baffle 404 and a discharge end opening 428 below the level 414 of the particulates of print material 412. The operations are not limited to a particular example described herein and may include additional operations such as those described in the apparatus 100 described in FIG. 1, the particulate delivery container 210 described in FIG. 2, and the system 320 described in FIG. 3.

As described herein, the particulate delivery container 430 may include a particulate reservoir container 402 to hold the particulates of print material 412. The particulate reservoir container 402 may include an input portion, an output portion, and at least one wall.

The particulate delivery container 430 may include the orifice 408, which may be positioned at the output portion of the particulate reservoir container 404. The orifice 408 may include an input portion to receive the particulates of print material 412 from the particulate reservoir container 402 and an output portion to transfer the particulates of print material 412 to the printing device's supply container. In one example, the orifice 408 may include a funnel-like configuration to avoid corners, sharp angles, and dead spots where the particles of print materials 412 may become trapped during the transfer of the particulates of print material 412.

As described herein, the particulate delivery container 430 may include a baffle 404 that when compressed forces air through an air valve 406 to direct the air below a level 414 of the particulates of print material 412 to aerate the particulates of print material 412. The particulates of print material 412 may become compressed within the particulate reservoir container 402 and/or the orifice 408 making it difficult to transfer the particulates of print material 412 to the printing device's supply container. Aerating the particulates of print material 412 may maximize the volume of particulates of print material 412 that is transferred from the particulate delivery container 430.

As described herein, in one example, the baffle 404 may be disposed externally of the particulate reservoir container 402, such as on an external surface of the particulate reservoir container 402. In another example, the baffle 404 may be disposed within the particulate reservoir container 402. The baffle 404 may be sealed or semi-sealed.

Pressure may be applied to the baffle 404 by, for example, a user or a pressure mechanism, to compress the baffle 404 forcing the air from the baffle 404 to the air valve 406. In one example, the baffle 404 may be capable of refilling with air upon compression via a one-way valve sealing mechanism 426. The one-way valve sealing mechanism 426 may be located within the air valve 406, The one-way air valve may ensure that during, before, and after the transfer of air from the baffle 404, the particulates of print material 412 do not enter the air valve 406.

As described herein, upon being compressed, the baffle 404 may force air through the air valve 406 to direct the air from the baffle 404 to the particulates of print material 412. The air may be directed below the level 414 of the particulates of print material 412. As illustrated in FIG. 4, a first portion of the air valve 406 may be disposed externally of the particulate reservoir container 402 and a second portion of the air valve 406 may be disposed within the orifice 408.

As described herein, the air valve 406 may include an input end opening 424 and a discharge end opening 428. The input end opening 424 may open into the baffle 404 to allow the transfer of air from the baffle 404 into the air valve 406. In one example, the discharge end opening 428 of the air valve may open into the orifice 408 below the level 414 of particulates of print material 412. In such an example, the discharge end opening 424 of the air valve 406 may intersect with a wall of the orifice 408 to direct the air at the particulates of print material 412. Aerating the particulates of print material 412 may aid in the particulate transfer from the particulate delivery container to a printing device's receiving container, maximizing the volume of particulates of print material 412 that transfer from the particulate delivery container 430. Therefore, minimizing the volume of trapped particulates of print material 412.

Figures 5A, 5B:
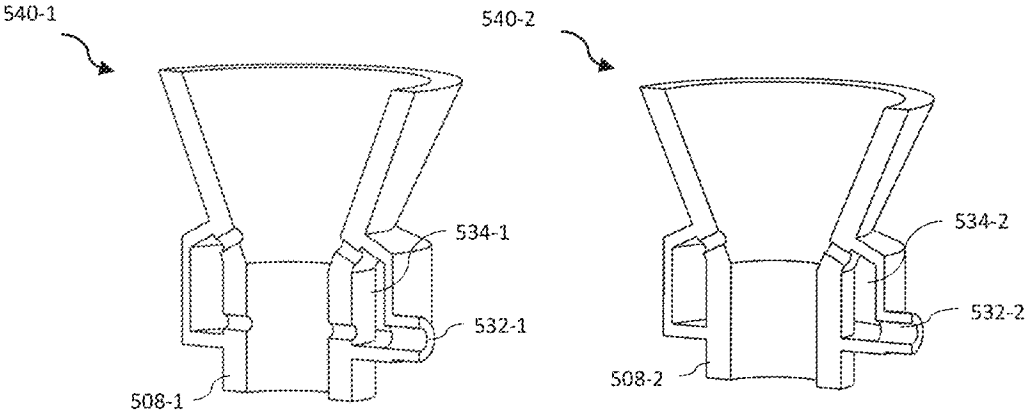
FIGS. 5A and 5B illustrate examples of particulate delivery containers consistent with the disclosure.

FIGS. 5A and 5B illustrate examples of particulate delivery containers 540-1, 540-2 consistent with the disclosure. As described herein, particulate delivery containers 540-1, 540-2 may include orifices 508-1, 508-2. As illustrated in FIGS. 5A and 5B the orifices 508-1, 508-2 may include air inlets 534-1, 534-2 to direct air at particulates of print material. The air inlets 534-1, 534-2 can intersect with the walls of the orifices 508-1, 508-2. Additionally, input portions 532-1, 532-2 of air inlets 534-1, 534-2 can be coupled to the discharge end opening of an air valve.

In one example, as illustrated in FIG. 5A, the air inlet 534-1 may be capable of simultaneously directing the air upwards towards an input portion of the particulate delivery container and horizontally across a portion of the orifice 508-1. In another example, as illustrated in FIG. 58, the air inlet 534-2 may be capable of directing the air upwards towards an input portion of the particulate delivery container. Directing the air into the orifices 508-1, 508-2 may direct air at particulates of print material to minimize the volume of trapped particulates of print material.

In the foregoing detailed description of the present disclosure, reference is made to the accompanying drawings that form a part hereof, and in which is shown by way of illustration how examples of the disclosure may be practiced. These examples are described in sufficient detail to enable those of ordinary skill in the art to practice the examples of this disclosure, and it is to be understood that other examples may be utilized and that process, electrical, and/or structural changes may be made without departing from the scope of the present disclosure.

In addition, dements shown in the various figures herein can be added, exchanged, and/or eliminated so as to provide a number of additional examples of the present disclosure. For example, a number of sensors within a component included in a transfer mechanism may be greater than or lesser than as illustrated in the example figures. The proportion and the relative scale of the elements provided in the figures are intended to illustrate the examples of the present disclosure and should not be taken in a limiting sense.

What is claimed:

1. An apparatus, comprising:

a particulate reservoir container;

an orifice positioned at an output portion of the particulate reservoir container, the orifice including an air inlet to direct air at particulates of print material; and a baffle that when compressed forces the air through an air valve to the air inlet to direct the air upwards toward an input portion of the particulate reservoir container and below the level of the particulates of the print material to aerate the particulates of the print material.

2. The apparatus of claim 1, wherein the baffle is disposed within the particulate reservoir container.

3. The apparatus of claim 1, wherein the baffle is disposed on an external surface of the particulate reservoir container.

4. The apparatus of claim 1, wherein the air valve is disposed within the particulate reservoir container.

5. The apparatus of claim 1, wherein a portion of the air valve is disposed externally of the particulate reservoir container.

6. The apparatus of claim 1, wherein the air valve has an input end opening into the baffle.

7. The apparatus of claim 1, wherein the air valve has a discharge end opening into the particulate reservoir container below the level of particulates of print material.

8. A system, comprising:

a particulate reservoir container;

an orifice positioned at an output portion of the particulate reservoir container, the orifice including an air inlet to direct air at particulates of print material; and a baffle coupled to an air valve, wherein when compressed the baffle forces the air through the air valve to the air inlet to direct the air upwards toward an input portion of the particulate reservoir container and below a level of the particulates of the print material to aerate the particulates of the print material.

9. The system of claim 8, wherein the air valve intersects with the orifice to direct the air at the particulates of print material.

10. The system of claim 8, wherein the air valve intersects with the particulate reservoir container to direct the air at the particulates of print material.

11. The system of claim 8, wherein a portion of the air valve is disposed at an angle to direct the air towards the level of the particulates of print material.

12. A particulate delivery container, comprising:

a particulate reservoir container;

an orifice positioned at an output portion of the particulate reservoir container, the orifice including an air inlet to direct air at particulates of print material; and a baffle that when compressed forces the air through a one-way air valve to the air inlet to direct the air upwards toward an input portion of the particulate reservoir container and below a level of the particulates of the print material to aerate the particulates of the print material, wherein the air valve includes an input end opening at the baffle and a discharge end opening below the level of the particulates of print material.

13. The particulate delivery container of claim 12, wherein the baffle is refilled with air upon compression via a one-way valve sealing mechanism.

14. The particulate delivery container of claim 12, wherein the baffle is sealed.

15. The particulate delivery container of claim 12, wherein the baffle is semi-sealed.

16. The particulate delivery container of claim 12, wherein the baffle is disposed within the particulate reservoir container.

17. The particulate delivery container of claim 12, wherein the baffle is disposed on an external surface of the particulate reservoir container.

18. The particulate delivery container of claim 12, wherein the air valve is disposed within the particulate reservoir container.

19. The particulate delivery container of claim 12, wherein a portion of the air valve is disposed externally of the particulate reservoir container.

20. The particulate delivery container of claim 12, wherein the air valve has an input end opening into the baffle.

* * * * *